US005370075A

United States Patent [19]

Rodskier

[11] Patent Number: 5,370,075

[45] Date of Patent: Dec. 6, 1994

[54] TWIN OUTBOARD STERN DRIVE BOAT PROPULSION UNIT

[75] Inventor: Christian Rodskier, Torslanda, Sweden

[73] Assignee: AB Volvo Penta, Gothenburg, Sweden

[21] Appl. No.: 191,657

[22] Filed: Feb. 4, 1994

[30] Foreign Application Priority Data

Feb. 4, 1993 [SE] Sweden ..... 9300343-2

[51] Int. Cl.[5] ..... B63B 1/24

[52] U.S. Cl. ..... 114/274; 440/63

[58] Field of Search ..... 440/49, 52, 53, 63, 440/113, 900; 114/274, 280, 281

[56] References Cited

U.S. PATENT DOCUMENTS

| | | | |
|---|---|---|---|
| 2,999,476 | 9/1961 | Johnson | 440/63 |
| 3,756,186 | 9/1973 | Nordling | 440/63 |
| 4,756,265 | 7/1988 | Cane | 114/274 |
| 5,049,097 | 9/1991 | Rodskier et al. | 440/63 |
| 5,134,954 | 8/1992 | Barry et al. | 114/274 |

*Primary Examiner*—Stephen P. Avila
*Attorney, Agent, or Firm*—Young & Thompson

[57] ABSTRACT

Boat propulsion unit, comprising two outboard Propeller drives (3,4), having anti-cavitation plates (7), which are coupled to each other via a tie-bar (10) with a wing profile. In the trim position of the stern drive for low speed, the wing profile has an angle of attack in order to exert a lifting force on the stern drives under the influence of the water flowing past it.

4 Claims, 1 Drawing Sheet

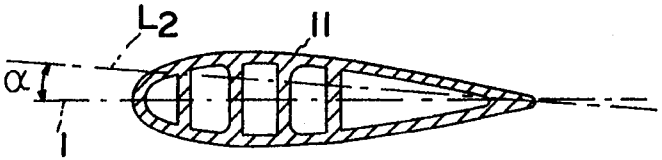
FIG.3
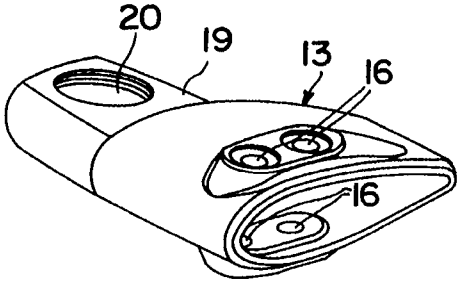
FIG.4
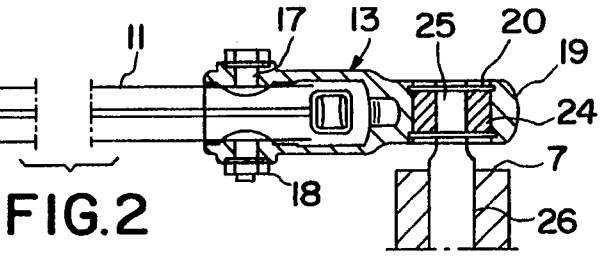
FIG.2
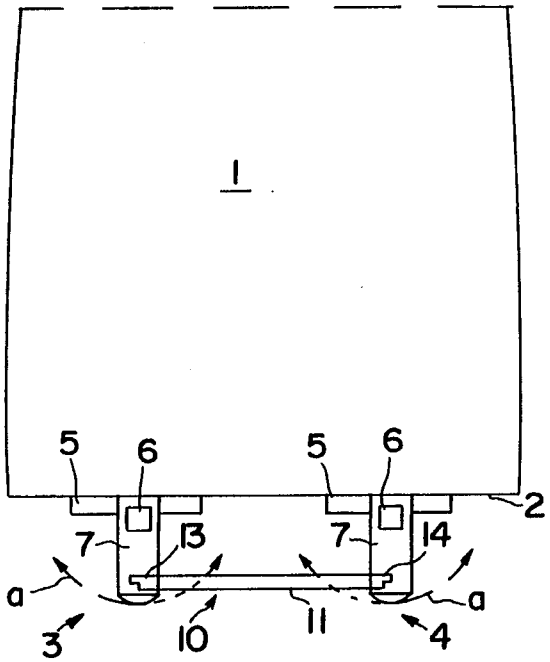
FIG.1
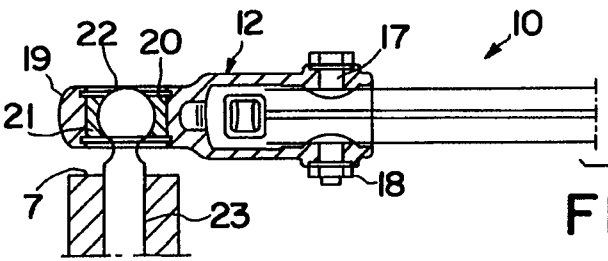

TWIN OUTBOARD STERN DRIVE BOAT PROPULSION UNIT

The present invention relates to a boat propulsion unit, comprising two outboard stern drives mounted in spaced relationship on the boat transom, said drives being pivotable for steering about essentially vertical steering axes, being tiltable about horizontal tilting axes for trimming, and being articulated to a tie-bar device for synchronizing the steering angle of the stern drive.

Tie-bars between stern drives in twin stern drive propulsion units are commonly used together with high powered engines installed in boats designed for high speed. In a known design, the tie-bar connects the anti-cavitation plates of the stern drive to each other, which provides a long moment arm between the bar mounting point and the respective steering axis, but also results in the bar lying submerged until the boat comes up into its planing position. Tie-bars known previously have been almost exclusively made of pipes or rods with circular cross section. Below said planing speeds when submerged they have created minor turbulence and a certain insignificant flow resistance but otherwise such tie-bars have not affected boat propulsion.

The purpose of the present invention is to provide a boat propulsion unit of the type described by way of introduction which has a tie-bar arrangement which can be used as a trim flap to bring the boat more rapidly up into its planing position.

This is achieved according to the invention by virtue of the fact that the tie-bar device comprises at least one bar with a wing profile, said bar being articulated between said stern drives at pivot mountings, which, when the boat is at rest and up to a certain speed below the planing threshold, lies submerged, and that the wing profile tie-bar, in at least one trim position of the stern drives, has such an angle of attack that the water flowing past it exerts a lifting force on the wing profile tie-bar.

Such a wing profile tie-bar can be fixed to the stern drives in such a manner that the wing profile when the boat is started and at speeds up to the planing threshold, when the stern drives are initially trimmed in towards the transom, has an angle of attack which results in said lifting force. When the stern drives are gradually trimmed out as the speed increases, the angle of attack becomes less, so that at the boat planing speed with the normal trim position of the stern drives, it is suitably equal to or approximately zero. The wing profile tie-bar thus functions both as a conventional tie-bar for synchronizing the steering angles and as an automatic trim lap.

The invention will be described in more detail below with reference to the an example shown in the accompanying drawings, where FIG. 1 shows a schematic plan view from above of the stern portion of a boat with twin outboard stern drives, FIG. 2 shows a partially sectioned side view of a wing profile tie-bar, FIG. 3 shows a cross-section through the tie-bar in FIG. 2, and FIG. 4 is a perspective view of an end fitting.

In FIG. 1, the numeral 1 designates the stern portion of a motorboat hull, the numeral 2 the transom and the numerals 3 and 4 two stern drives, which can be of the type Aquamatic ®, each of which comprising a shield 5 screwed securely into the transom 2 and in which a propeller rig 6 is pivotally mounted about an essentially vertical steering axis at the centre of the arcs designated "a". Each rig 6 has an anti-cavitation plate 7. A tie-bar, generally designated 10, is articulated between the anti-caviation plates 7 to synchronize the steering movement of the stern drive.

FIGS. 2–4 show an embodiment of the tie-bar 10 in greater detail. The tie-bar 10 comprises a beam 11 with a wing profile (see FIG. 3) and a pair of end fittings 12 and 13, respectively, screwed securely to the end of the beam 11 (see FIG. 4). The beam 11 is in a preferred embodiment an extruded hollow aluminum profile with reinforcing ribs 14 running longitudinally in the hollow interior. The beam 11 is uniform over its entire length and is open at the ends, which means that simple cross cutting will sufficient to adapt the length to the installation in question. Since the ends of the beam are inserted into a cavity in each end fitting 12, 13, the cut surfaces do not need to be finely worked or surface treated. In the embodiment shown, the end fittings 12, 13 can be of cast aluminum and be provided with holes 16. They are fixed to the beam by means of screws 17 and nuts 18.

At their outer ends, the end fittings 12, 13 have a bearing holder portion 19 with a cylindrical cavity 20. In the cavity 20 of the end fitting 12 there is fixed a bearing shell 21, which has a spherical socket fitting around a ball 22 on a pin 23. In the cavity 20 of the other end fitting 13 a bushing 24 is fixed, which has a cylindrical bearing surface adapted to a cylindrical shaft 25 on a pin 26. The pins 23 and 26 are screwed securely to the anti-cavitation plates 7 of the stern drives 3, 4. The angle of the cylindrical shaft 25 relative to the anti-cavitation plate 7 determines the angle of the wing profile tie-bar 10 relative to the stern drives 3, 5 and consequently the angle of attack $\alpha$ as well, as is indicated in FIG. 3, where $1_1$ indicates the wing profile lying in the horizontal plane and $1_2$ indicates its position with the drives trimmed in for start. The ball and socket joint 21, 22 permits a certain difference in the trim angle of the stern drives to eliminate the risk of damage to the joints in the event of non-uniform trimming of the stern drives.

In tests conducted with a boat with twin outboard stern drives of the type described which were coupled together by means of an 800 mm long and 90 mm wide wing profile, a lifting force of about 2000N was obtained at a speed of about 15 knots.

I claim:

1. Boat propulsion unit in a planing boat, comprising two outboard stern drives mounted in spaced relationship on a boat transom, said drives being pivotable for steering about essentially vertical steering axes, being tiltable about horizontal tilting axes for trimming and being articulated to a tie-bar device for synchronizing the steering angle of the stern drive, characterized in that the tie-bar device comprises at least one bar (10) with a wing profile, said bar being articulated between said stern drives (3,4) at pivot mountings (21,22,24,25), which, when the boat is at rest and up to a certain speed below the planing threshold, lie submerged, and that the wing profile tie-bar, in at least one trim position of the stern drives, has such an angle of attack ($\alpha$) that the water flowing past it exerts a lifting force on the wing profile tie-bar.

2. Boat propulsion unit according to claim 1, characterized in that the stern drives (3,4) have anti-cavitation plates (7) and that the wing profile tie-bar (10) is articulated between the anti-cavitation plates.

3. Boat propulsion unit according to claim 2, characterized in that the wing profile tie-bar (10) is articulated to one anti-cavitation plate (7) via a journal (24,25) and to the other anti-cavitation plate (7) via a ball and socket joint (21,22).

4. Boat propulsion unit according to claim 3, characterized in that the wing profile tie-bar (10) comprises an extruded bar beam (11) and a pair of end fittings (12,13), which are fixed to the end of the beam and one of which (13) has a cylindrical bearing surface (24) for a journal (25) on one stern drive (4) and the other (12) a socket (21) for a ball (22) on the other stern drive (3).

* * * * *